US012402723B2

(12) United States Patent
Baker et al.

(10) Patent No.: US 12,402,723 B2
(45) Date of Patent: Sep. 2, 2025

(54) ROBOT COMPETITION TABLE

(71) Applicant: AndyMark, Inc., Kokomo, IN (US)

(72) Inventors: Andrew R. Baker, Kokomo, IN (US); Daniel M. Blau, Kokomo, IN (US); Jonathan J. Kentfield, Kokomo, IN (US); Elisabeth C. Smith, Kokomo, IN (US); Jay H. Kinzie, Arlington Heights, IL (US)

(73) Assignee: AndyMark, Inc., Kokomo, IN (US)

( * ) Notice: Subject to any disclaimer, the term of this patent is extended or adjusted under 35 U.S.C. 154(b) by 840 days.

(21) Appl. No.: 17/526,600

(22) Filed: Nov. 15, 2021

(65) Prior Publication Data

US 2022/0152473 A1 May 19, 2022

Related U.S. Application Data

(60) Provisional application No. 63/115,332, filed on Nov. 18, 2020.

(51) Int. Cl.
*A47B 13/08* (2006.01)
*A47B 37/00* (2006.01)

(52) U.S. Cl.
CPC ..... *A47B 37/00* (2013.01); *A47B 13/088* (2013.01)

(58) Field of Classification Search
CPC .... A47G 1/065; A47G 1/0605; A47G 1/0611; A47B 2200/0007; A47B 13/088; A47B 37/00; A47B 87/002; A47B 1/02
See application file for complete search history.

(56) References Cited

U.S. PATENT DOCUMENTS 907,926 A * 12/1908 Westerfield ..... A47B 1/02 108/85
3,428,108 A * 2/1969 Singer ..... E04B 2/7431 40/605
4,017,989 A * 4/1977 Murray ..... G09F 1/12 40/605
5,921,095 A * 7/1999 Lee ..... F25D 29/005 62/DIG. 13
2003/0228944 A1* 12/2003 Scruby ..... A63B 71/04 473/496
2016/0309926 A1* 10/2016 Jhagroo ..... A47G 1/065
2019/0318663 A1* 10/2019 Ortiz ..... A47B 3/12

FOREIGN PATENT DOCUMENTS

KR 102105593 B1 * 4/2020

* cited by examiner

*Primary Examiner* — Matthew W Ing
(74) *Attorney, Agent, or Firm* — Barnes & Thornburg

(57) ABSTRACT

A robot competition field assembly including field end sections, a field mid-section, and a field alignment system. The field end sections and the field mid-section include panels and sidewalls. The field alignment system is configured to align the panels so that there is a smooth transition between each of the playing surfaces of the field end sections and field mid-section.

14 Claims, 7 Drawing Sheets

ROBOT COMPETITION TABLE

PRIORITY CLAIM

Figure 1:
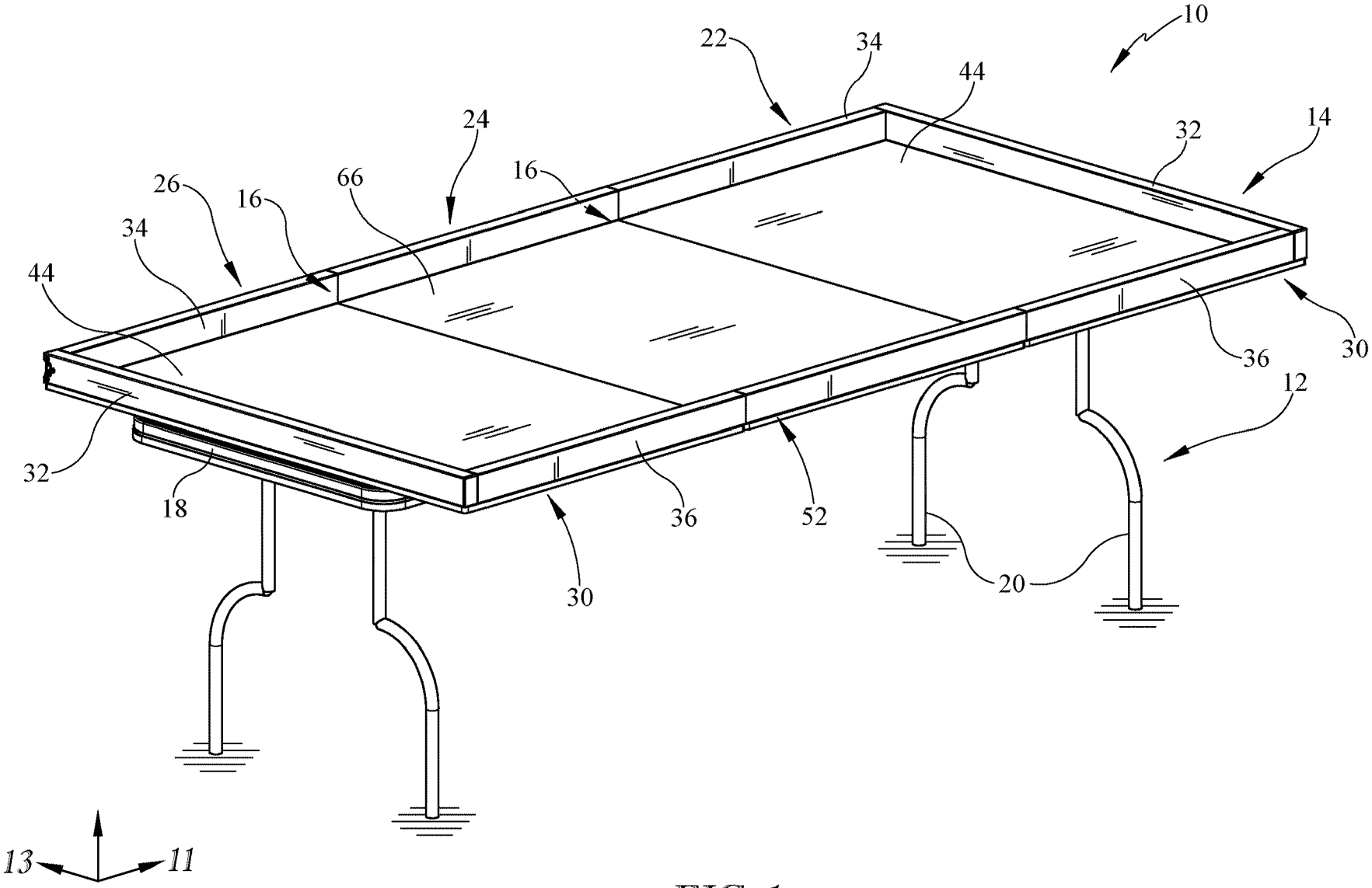

This application claims priority under 35 U.S.C. § 119(e) to U.S. Provisional Application Ser. No. 63/115,332, filed Nov. 18, 2020, which is expressly incorporated by reference herein.

BACKGROUND

Robotic competitions are events where robots compete against other robots in specific tasks to show various abilities and functions. Different competition games are set out on a competition field and competing robots move around the field to complete the game.

Competition fields are often built to a regulated size on the site of a competition. These competition fields can be bulky and hard to store or transport. For example, robotic competitions held by FIRST LEGO League incorporate a regulated competition field that has a cumbersome size when in use. Accordingly, there is a need for competition fields that can be used for robotic competitions while allowing for easy storage and transport.

SUMMARY

A field for robotic competitions according to this disclosure includes a number of sections assembled together for use so as to allow for disassembled storage and transportation. More specifically, an exemplary competition field includes field end-sections and at least one field mid-section. The competition also includes a field alignment system that provides means for locating and coupling sections of the competition field so as to ensure smooth transitions along important surfaces and secure attachment of the sections when in use.

In illustrative embodiments, sections of the competition field are made up of a panel that provides a playing surface and walls that surround the playing surface when assembled. The panels may be made from ply wood or other suitable material. The walls may be made from extruded plastic tube or other suitable material.

In illustrative embodiments, the field alignment system includes brackets that extend inside walls between sections of the field and pins that extend inside panels between section of the field. The brackets function to align the walls and the playing surface of the competition field along outside edges of the competition field. The pins function to align panels that form the playing surface along the mid span of the competition field.

In illustrative embodiments, a larger robotic competition field system may be provided by multiple robotic competition fields arranged side-by-side. Such systems can include coupling means for fixing robotic competition fields together in pre-set positions relative to one another. For example, a first robotic competition field and second robotic competition field may include integrated latches and catches that are engaged to fix the fields in position relative to one another.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

Figures 2, 3, 4:
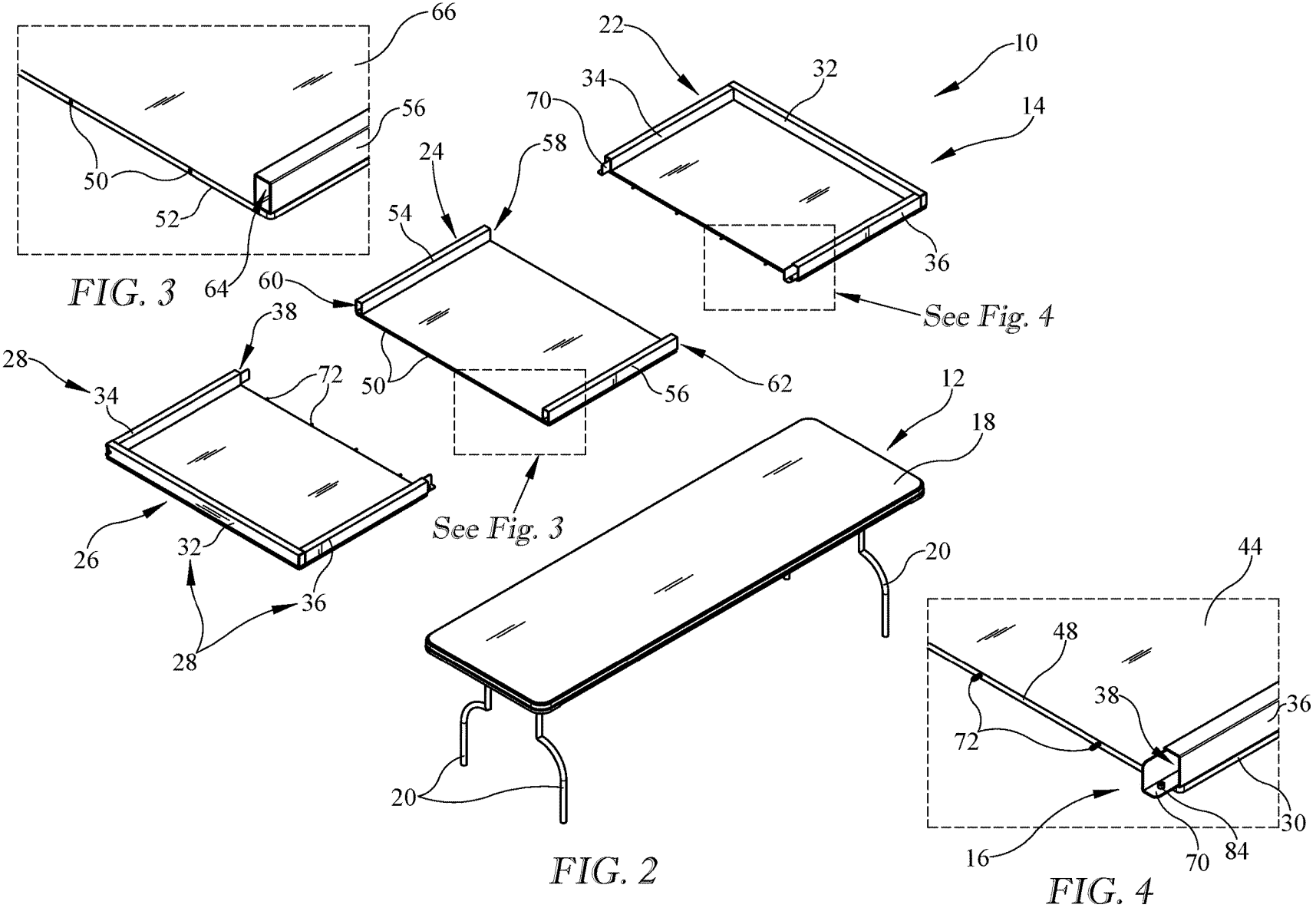
Figure 5:
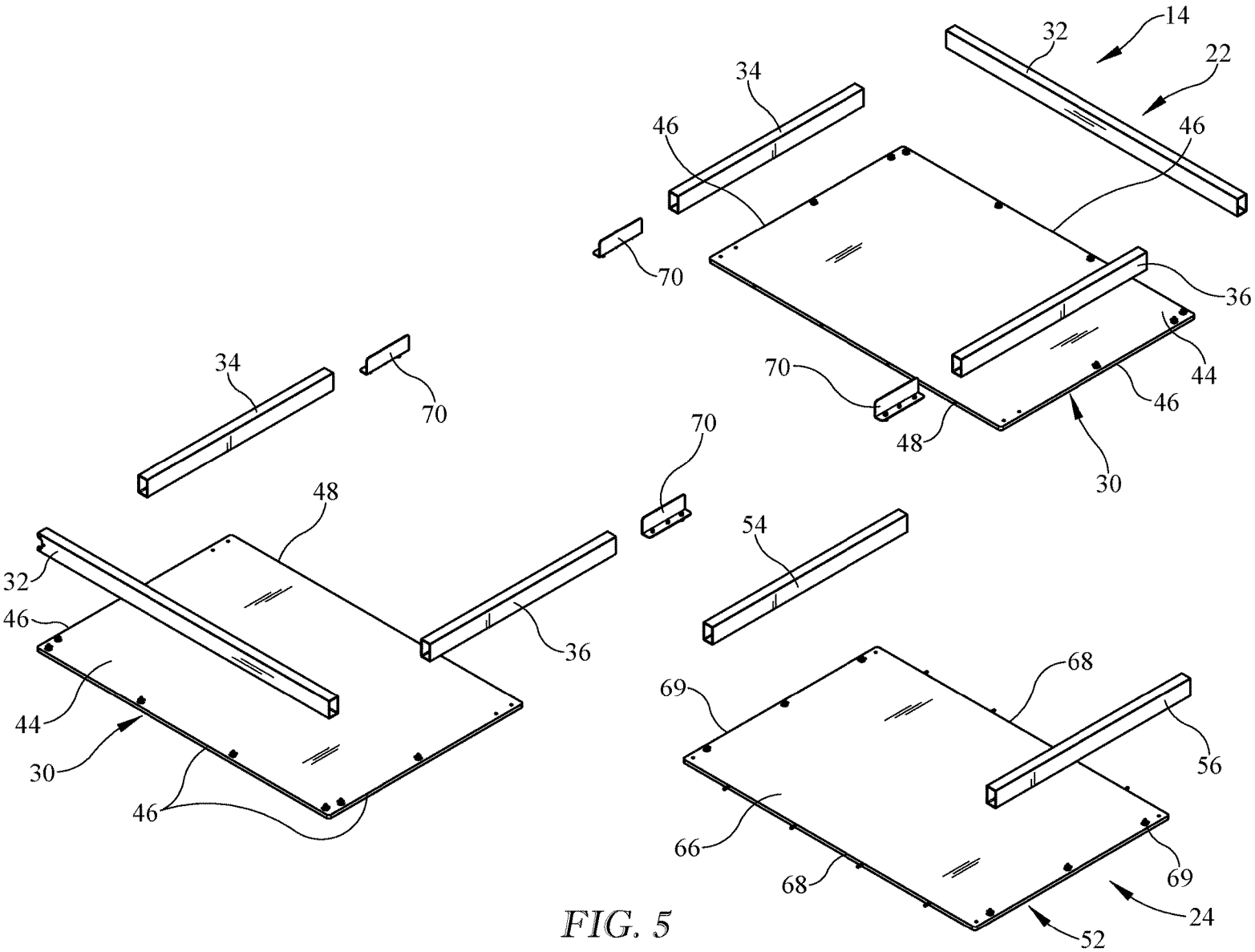
Figure 6:
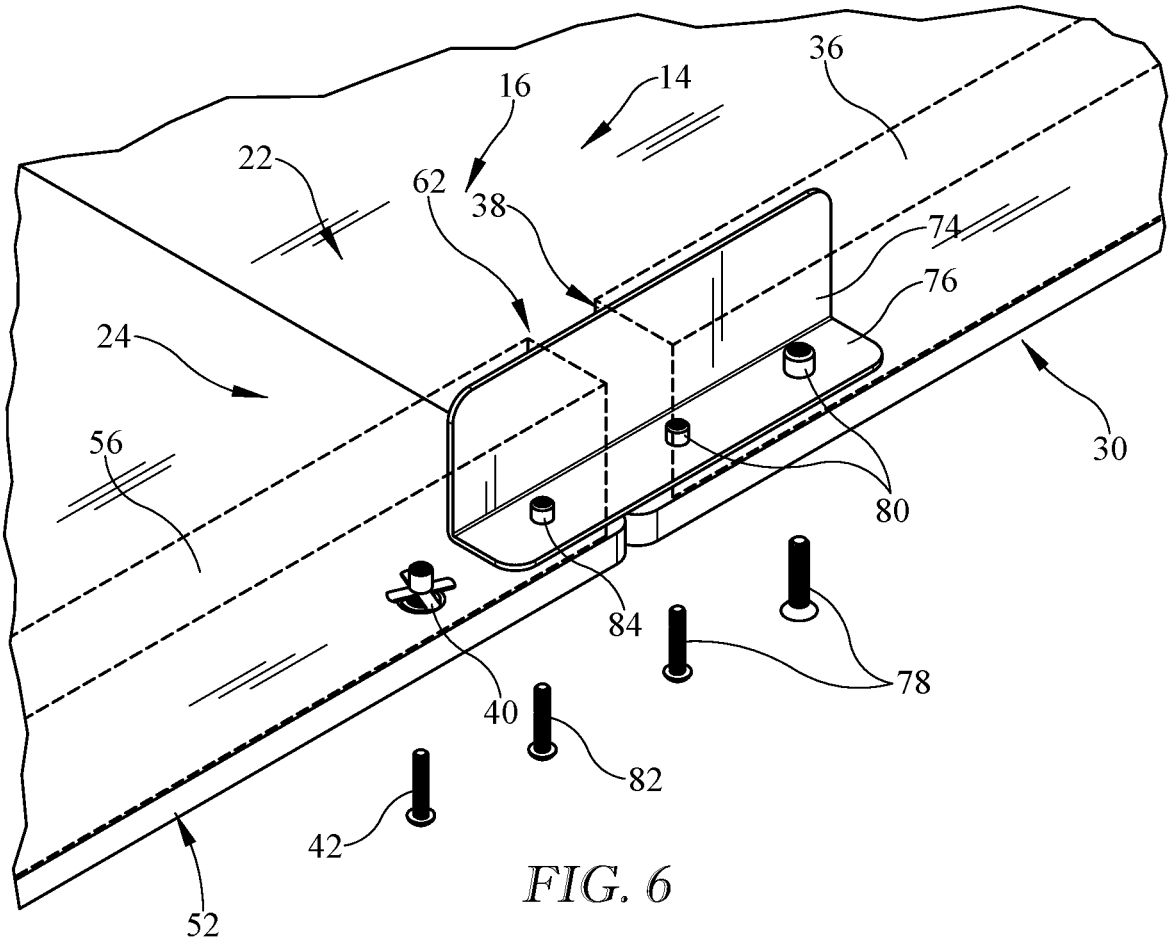
Figure 7:
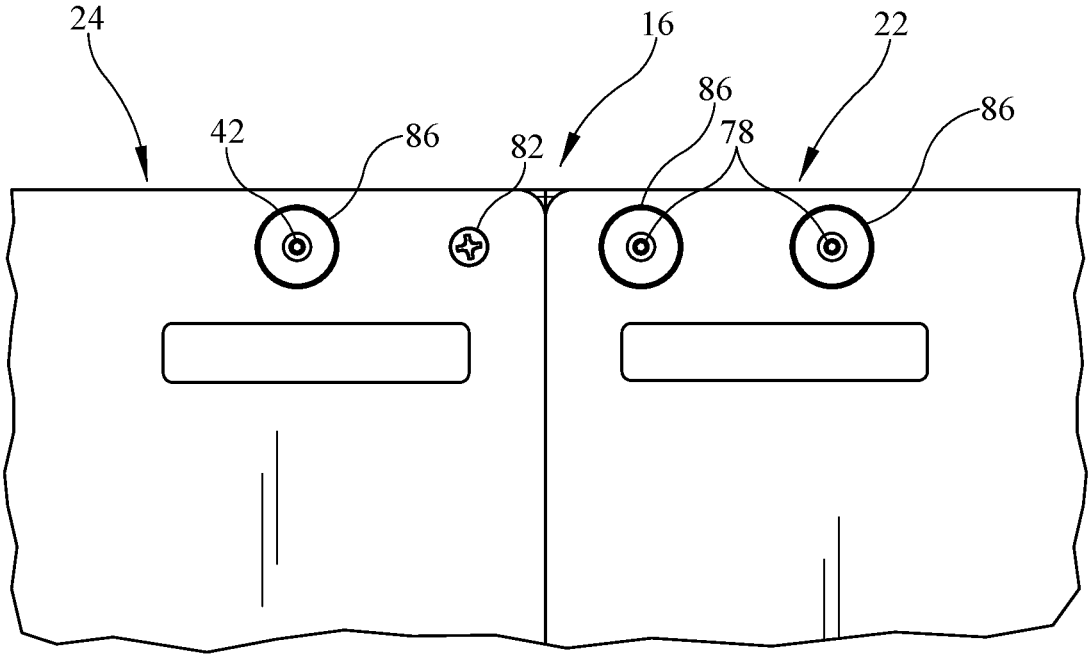
Figure 8:
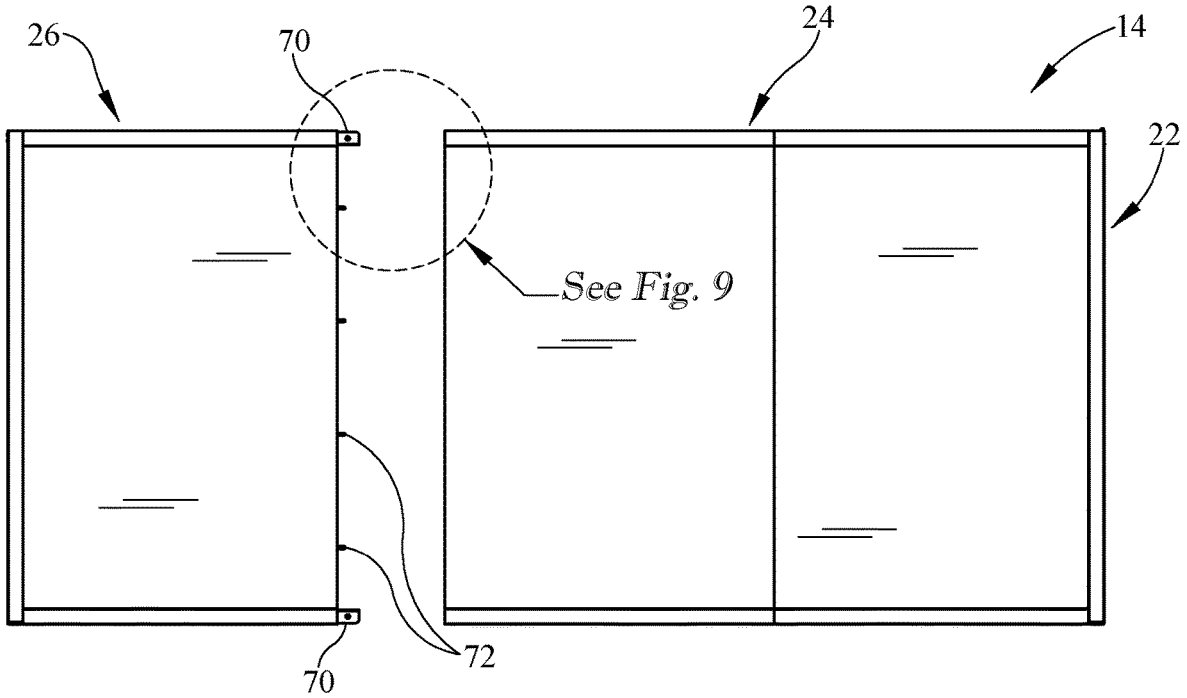
Figure 9:
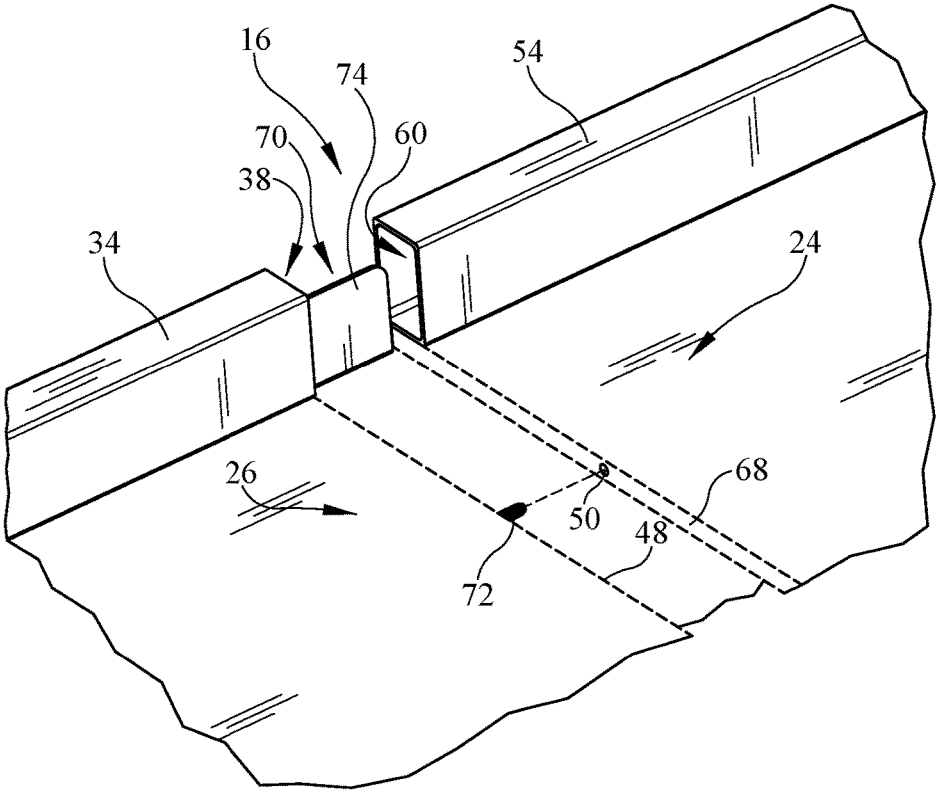
Figure 10:
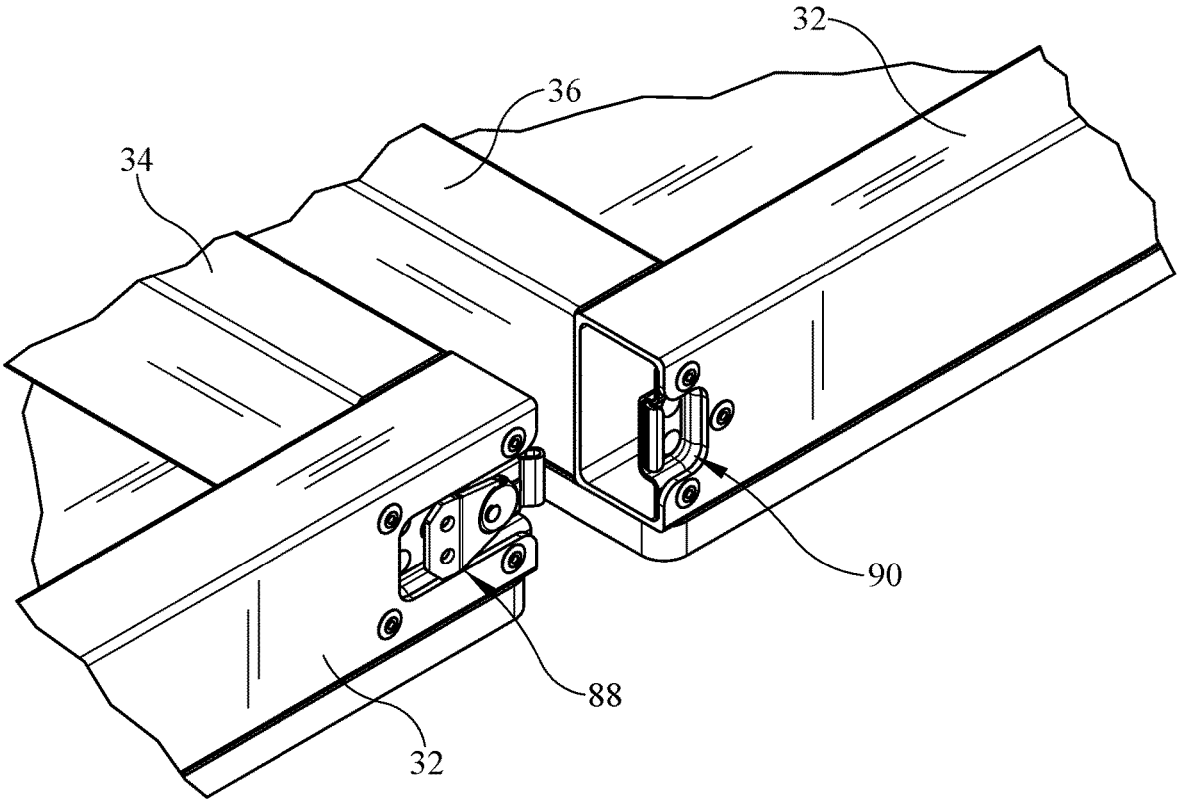
Figure 11:
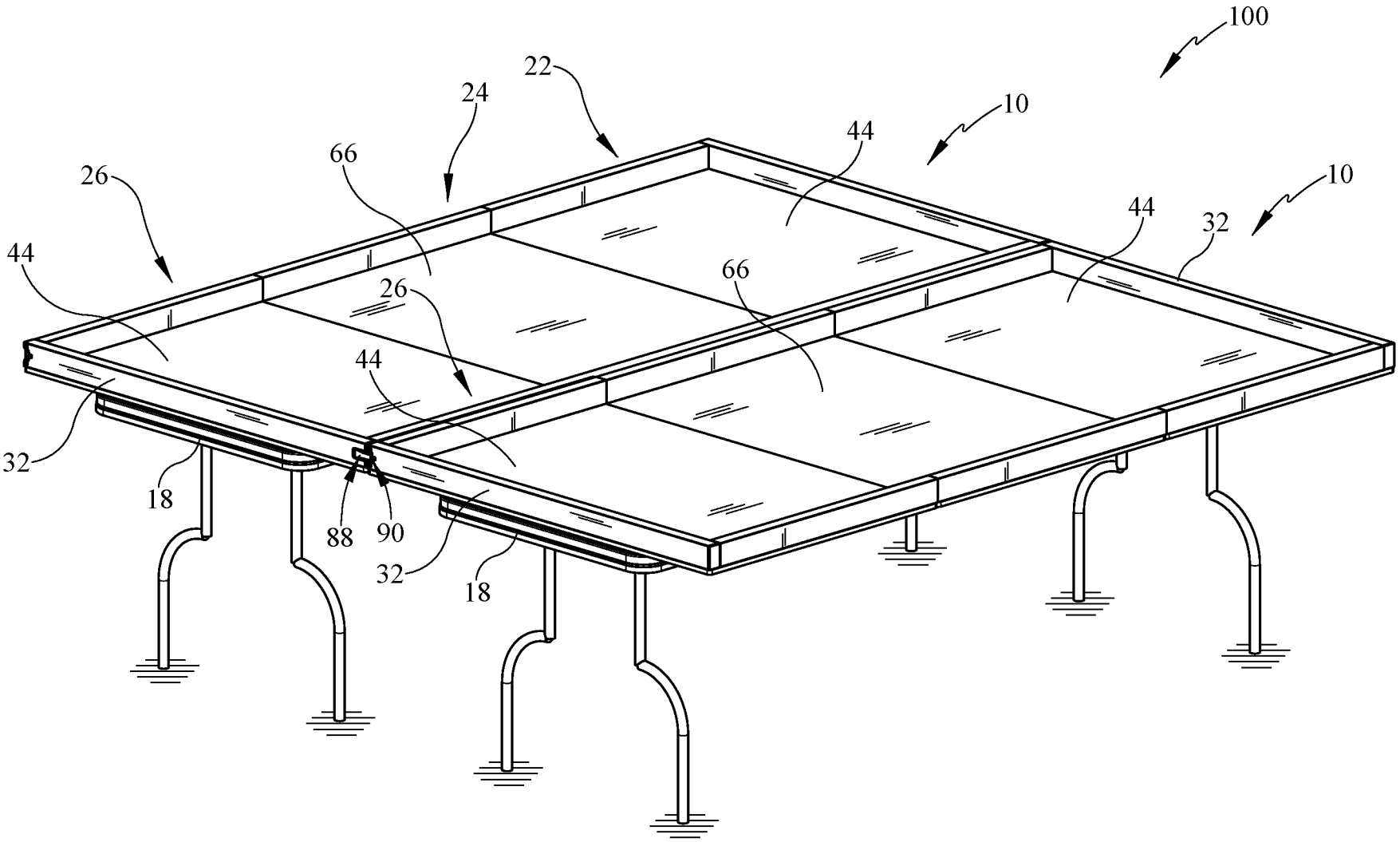

The detailed description particularly refers to the accompanying figures in which:

FIG. 1 is a perspective view of a robot competition field system that includes a robot competition field supported by a table so that the robot competition field is elevated off the ground, the view showing that the robot competition field includes three field sections that couple together via a field a field alignment system to form a smooth playing surface and a perimeter wall that extends around the smooth playing surface with smooth joints where the three field sections couple together;

FIG. 2 is an exploded perspective view of the robot competition field system of FIG. 1, showing the robot competition field has two field end sections and a field mid-section located between the field end sections, and further showing that side walls of the end sections contain brackets that extend into corresponding side walls of the field mid-section to align and couple the three field sections when assembled;

FIG. 3 is a detailed view of a portion of FIG. 2 showing the side walls of the field mid-section are rectangular extruded tubes sized to receive the brackets of the field end sections, and further showing that coupling edges of the field mid-section include a plurality of pin receiving apertures that receive alignment pins from the coupling edges of the field end sections;

FIG. 4 is a detailed view of a portion of FIG. 2 showing that the side walls of the field end sections are rectangular extruded tubes and the brackets are L-shaped with a vertical wall that extends along an inside edge of the side wall closest to the playing field and a horizontal wall that extends along a bottom surface of the side wall to couple the bracket to the side wall and end panel together, and further showing that coupling edges of the field end sections have a plurality of alignment pins that extend into the plurality of pin receiving apertures of the field mid-section to align the end panels and the mid-panel so that the robot competition field has a smooth surface across the joints of the field sections;

FIG. 5 is an exploded perspective view of the robot competition field of FIG. 2 showing that each of the end walls and side walls couple to perimeter edges of the end panels of the field end sections and the brackets assemble into the ends of the side walls and couple therewith, and the side walls couple to the mid-panel of the field mid-section;

FIG. 6 is a detailed perspective view of the robot competition field of FIG. 2 showing the bracket is assembled inside side walls of the field mid-section and the field end sections, the bracket is coupled with two bolts to the field end section and the bracket is coupled with an easy-assembly bolt to the field mid-section. FIG. 6 further shows that the sidewalls are coupled to the end panels and mid-panel using a bolt and flared nut that is located inside the rectangular extruded tube;

FIG. 7 is a detailed view of the underside of the robot competition field of FIG. 6 showing the easy-assembly bolt uses a phillips screw head and the remaining bolts are located in recesses on the underside of the end panels and mid-panel;

FIG. 8 is a top perspective view of the robot competition field of FIG. 1 showing one of the field end section coupled to the field mid-section at the corresponding coupling edges, and the other field end section spaced apart from the field mid-section so that the brackets and alignment pins of the field end section are aligned with the corresponding features of the field mid-section, and the field end section can be slid into position to couple with the field mid-section;

FIG. 9 is a detailed perspective view of the robot competition field of FIG. 8 showing the bracket of the field end section is aligned with the rectangular aperture of the side wall of the field mid-section so that it can slide into the assembled position to couple therewith, and the alignment pins of the field end section are aligned with the pin receiving apertures of the field mid-section so that the field end section can slide into the assembled position to couple therewith;

FIG. 10 is a detailed perspective view of two adjacent robot competition fields, and the first robot competition field includes an integrated latch at a terminal end of the end wall of the one of the field end sections, and the second robot competition field includes an integrated catch at a terminal end of the end wall of one of the field end sections so that the two robot competition fields can be coupled together, and FIG. 11 is a perspective view of two adjacent robot competition fields forming a robot competition field system on which one or two simultaneous games may be played with the integrated latches/catches of FIG. 10 fixing the fields together in a pre-set alignment relative to one another.

DETAILED DESCRIPTION

An illustrative robot competition field assembly 10 includes a table 12 and a robot competition field 14 as shown in FIG. 1. The robot competition field 14 may be disassembled into three field sections 22, 24, 26 and has a field alignment system 16 that couples each of the field sections 22, 24, 26 together. The field alignment system 16 is adapted to provide a flat playing surface on which robot competition games can be played. Each of the three field sections 22, 24, 26 include panels 30, 52 that provide a portion of a playing surface, and endwalls 32 and sidewalls 34, 36, 54, 56 that form a perimeter wall around the flat playing surface. The field alignment system includes a plurality of brackets 70 that extend and couple between adjacent sidewalls 34, 36, 54, 56, and a plurality of alignment pins 72 that extend between adjacent coupling edges 48, 68 of each of the field sections 22, 24, 26 as shown in FIG. 2.

The plurality of brackets 70 of the field alignment system 16 are L-shaped and extend into the sidewalls 34, 36 of the field end sections 22, 26 and are fixed to move therewith as shown in FIG. 6. Each of the brackets extend out of the sidewalls 34, 36 and into the sidewalls 54, 56 of the field mid-section 24 and couple with field mid-section 24 with an easy-assembly bolt 82. The plurality of brackets 70 and the plurality of alignment pins 72 provide strength and rigidity to the robot competition field 14 and align the edges of the panels 30, 52 and the sidewalls, 34, 36, 54, 56 so that the robot competition field 14 does not have any steps at the joints between the field sections 22, 24, 26.

The robot competition field 14 is supported in an elevated position by the table 12 as shown in FIG. 1. The table 12 is a folding table that includes a table top 18 and a plurality of legs 20. The plurality of legs 20 extend downward from the table top 18 and engage the ground to keep the table top 18 spaced apart and elevated away from the ground. The robot competition field 14 is located on the table top 18. In some embodiments, the table 12 may be replaced by a fixed table, a box, an eight-foot banquet table, a tote container, or other suitable support. In other embodiments, the robot competition field 14 may be placed directly on the ground.

The robot competition field 14 provides a flat playing surface for robot competition games to be played on and has rectangular shape with length along a longitudinal axis 11 and width along a lateral axis 13 as shown in FIG. 1. The robot competition field 14 includes a first field end section 22, a field mid-section 24, and a second field end section 26 that couple together in series along the longitudinal axis 11 as shown in FIG. 2. This allows for the robot competition field 14 to be decoupled into smaller sections so that the robot competition field 14 is easier to transport and carry. Each of the field sections 22, 24, 26 may be sized so that when they are coupled together they form a regulation size competition field, but when they are decoupled they will fit inside a small vehicle.

The first field end section 22 and the second field end section 26 are substantially similar and contain the same features as shown in FIG. 2. The first field end section 22 is located on one end of the robot competition field 14, and the second field end section 26 is located on the opposite end of the robot competition field 14. The field mid-section 24 is located between the first field end section 22 and the second field end section 26. In some embodiments, the robot competition field 14 may include more than one field mid-section 24 so that each of the field sections have a smaller length along the longitudinal axis 11 and each field section may be more compact in the decoupled configuration for transport.

The first and second field end sections 22, 26 each include an end panel 30 and perimeter walls 28 that extend around three of the four edges of the end panel 30 as shown in FIGS. 2 and 3. The end panel 30 includes a playing surface 44, a coupling edge 48, and perimeter edges 46 that comprise the three edges of the end panel 30 that is not the coupling edge 48. The playing surface 44 faces outward from the ground and is substantially flat. The coupling edge 48 extends along the lateral axis 13 and faces the field mid-section 24.

The perimeter walls 28 provide a barrier so that a robot will not fall off the robot competition field 14 when a game is taking place. The perimeter walls 28 include an endwall 32 and two sidewalls 34, 36 as shown in FIGS. 2 and 3. The endwall 32 extends along the perimeter edge 46 opposite the coupling edge 48 of the end panel 30. The endwall 32 extends outward from the playing surface 44 and is made from rectangular extruded tube. The endwall 32 is coupled to the end panel 30 with a plurality of flared nuts 40 and fixed bolts 42. The sidewalls 34, 36 extend along the longitudinal axis on the remaining two perimeter edges 46. The sidewalls 34, 36 extend outward from the playing surface 44 and are made from rectangular extruded tube. Each of the sidewalls 34, 36 are perpendicular to the endwall 32 and abut opposite terminal ends of the endwall 32. Each of the sidewalls 34, 36 are coupled to the end panel 30 with a plurality of flared nuts 40 and fixed bolts 42. The sidewalls 34, 36 form assembly apertures 38 at the terminal ends of the sidewalls 34, 36 at the coupling edge 48.

The field mid-section 24 includes a mid-panel 52 and two sidewalls 54, 56 as shown in FIGS. 2 and 3. The mid-panel 52 includes a playing surface 66, two coupling edges 68 that extend in the lateral direction, and two side edges 69 that extend in the longitudinal direction. The playing surface 66 faces outward from the ground and is substantially flat. The coupling edge 68 are on opposite sides of the mid-panel 52 and face each of the coupling edges 48 on the first and second field end sections 22, 26. Each of the coupling edges 68 include a plurality of receiving pin apertures 50 that extend into the mid-panel 52 and engage the field alignment system 16.

The sidewalls 54, 56 extend along the longitudinal axis on side edges 69. The sidewalls 54, 56 extend outward from the playing surface 66 and are made from rectangular extruded tube. Each of the sidewalls 54, 56 are coupled to the mid-panel 52 with a plurality of flared nuts 40 and fixed bolts 42. The sidewall 54 forms an assembly aperture 58 at one terminal end of the sidewall 54 that faces the first field end section 22 and an assembly aperture 60 at the other terminal end of the sidewall 54 that faces the second field end section 26. The sidewall 56 forms an assembly aperture 62 at one terminal end of the sidewall 56 that faces the first field end section 22 and an assembly aperture 64 at the other terminal end of the sidewall 56 that faces the second field end section 26.

The field alignment system 16 couples the first field end section 22 to the field mid-section 24 on one side of the field mid-section 24, and the second field end section to the field mid-section 24 on the opposite side of the field mid-section 24 as shown in FIGS. 1 and 2. The field alignment system 16 aligns the playing surfaces 44, 66 of each of the field sections 22, 24, 26 so that they form a substantially flat playing surface without steps at the joints between the field sections 22, 24, 26. In the illustrative embodiment shown in the FIG. 8, the first field end section 22 is coupled with the field mid-section 24, and the second field end section 26 is aligned and ready to be coupled with the field mid-section 24.

The field alignment system 16 includes a plurality of brackets 70 and a plurality of alignment pins 72 as shown in FIGS. 2-4, 6 and 9. The plurality of brackets 70 includes a bracket that couples to each of the assembly apertures 58, 60, 62, 64 of the field mid-section 24. One of the brackets 70 is shown in the illustrative embodiment in FIG. 6. The bracket 70 extends into the assembly aperture 38 of the sidewall 36 of the first field end section 22 and is coupled to the sidewall 36 with two fixed bolts 78 and two fixed nuts 80. The bracket 70 protrudes out of the sidewall 36 of the first field end section 22 and into assembly aperture 62 of the sidewall 56 of the field mid-section 24 and is coupled to the sidewall 56 with an easy-assembly bolt 82 and an assembly nut 84. In the illustrative embodiment, the easy-assembly bolt has a Phillips head configuration so that only a Phillips head screw driver is needed to assembly the robot competition field 14. In other embodiments, the easy-assembly bolt may have a different fixing arrangement such as a flat head configuration, a hex-type configuration, a Torx-type configuration, or other bolt head configuration.

One bracket 70 extends into the assembly aperture 38 of the sidewall 34 of the first field end section 22 and into assembly aperture 58 of the sidewall 54 of the field mid-section 24. One bracket 70 extends into the assembly aperture 38 of the sidewall 34 of the second field end section 26 and into assembly aperture 60 of the sidewall 54 of the field mid-section 24. One bracket 70 extends into the assembly aperture 38 of the sidewall 36 of the second field end section 26 and into assembly aperture 64 of the sidewall 56 of the field mid-section 24.

The bracket 70 has L-shape and includes a vertical leg 74 and a horizontal leg 76 as shown in FIG. 6. The vertical leg 74 extends outwardly and adjacent to an inside wall of the sidewalls 36, 56 so that the sidewalls 36, 56 are aligned along the surface of the sidewalls 36, 56 that faces the playing area of the robot competition field 14. The horizontal leg extends in the lateral direction and adjacent to a bottom wall of the sidewalls 36, 56 so that the mid-panel 52 and the end panel 30 are vertically aligned and the playing surface 44, 66 have a smooth transition across the joint.

The plurality of alignment pins 72 are equally spaced apart along the width of the coupling edges 48 of the first and second field end sections 22, 26 as shown in FIGS. 2, 8, and 9. The plurality of alignment pins 72 extend outwardly from the coupling edge 48 parallel to the longitudinal axis 11. The plurality of alignment pins 72 are aligned with the plurality of receiving pin apertures 50 in the coupling edges 68 of the field mid-panel 52 as shown in FIG. 8. When the field sections 22, 24, 26 are coupled together, the plurality of alignment pins 72 extend into the corresponding plurality of receiving pin apertures 50.

The L-shaped brackets 70 and the rectangular extruded tube sidewalls 34, 36, 54, 56 provide additional rigidity to the mid-panel 52 and end panels 30 to prevent warping and bending along the length of the robot competition field 14. The alignment pins 72 provide rigidity along the coupling edges 48, 68 of the mid-panel 52 and the end panels 30 to prevent warping and bending along the width of the robot competition field 14.

Recesses 86 are provided on the underside of the mid-panel 52 and end panels 30 as shown in FIG. 7. The recesses 86 allow the fixed bolts 42, 78 to be located within the recesses 86 so that the fixed bolts 42, 78 do not protrude beyond the underside of the mid-panel 52 and the end panels 30 and the underside of the robot competition field 14 remains substantially flat. The easy-assembly bolts 82 extend through apertures in the mid-panel 52 and have countersinks so that the underside of the mid-panel 52 remains substantially flat.

An integrated latch 88 is provided in one of the terminal ends of the endwall 32 and an integrated catch 90 is provided on the opposite terminal end of the endwall 32 as shown in FIG. 10. The integrated latch 88 may be used to couple to an integrated catch 90 in a second robot competition field that is adjacent to the first robot competition field 14 as shown in FIG. 11 to provide a robot competition field system 100. Multiple robot competition field may be coupled together with the integrated latches 88 and integrated catches 90 in series in the lateral axis 13 direction. Integrated latches 88 may also hold two tables together in series in the longitudinal axis 11 direction.

The present disclosure provides multiple advantages over the simple plywood competition tables currently used. The robot competition field 14 may be quickly disassembled into three field sections 22, 24, 26 for easy storage at home, in a classroom, or between tournaments. The field sections 22, 24, 26 may fit into small vehicles for transportation, or be carried by one adult or two students (each section may weigh about 22 lb). The field alignment system 16 couples the field sections 22, 24, 26 together to allow the playing surfaces to provide a consistent playing surface. The easy-assembly bolts allow for one Phillips Head Screwdriver to reassemble field sections 22, 24, 26 for use. The perimeter walls 28 and sidewalls 54, 56 may be adjusted using the fixed bolts 42 and flared nuts 40 to allow for corrections to be made to their location relative to the mid-panel 52 and end panels 30.

The sidewalls 34, 36, 54, 56 and endwalls 32 may be made from extruded black ABS plastic. The mid-panel 52 and the end panels 30 may be made from light weight MDF. The fixed bolts 42, 78 may be rivnuts.

The invention claimed is:

1. A robot competition field assembly, the assembly comprising a field elevator including a table top that has horizontal orientation and a plurality of legs coupled to table top and extending downwardly from the table top to keep the table top spaced apart from the ground, a competition field supported by the table top of the field elevator in an elevated position, the competition field including (i) a first field end section, (ii) a second field end section, and (iii) a field mid-section located between the first and second field end sections, the first and second field end sections each include an end panel having a playing surface, a coupling edge, and three perimeter edges, and three perimeter walls that each extend upwardly from the playing surface at each of the three perimeter edges, and the field mid-section includes a mid-panel having a playing surface, two coupling edges, and two side edges, and two side walls that extend upwardly from the playing surface at the two side edges, and a field alignment system that couples the first field end section to the field mid-section at the adjacent corresponding coupling edges and couples the second field end section to the field mid-section at the adjacent corresponding coupling edges, the field alignment system includes a plurality of brackets that extend from inside the perimeter walls at the coupling edge of the first and second field end sections to inside the side walls of the field mid-section and couple therewith, and a plurality of alignment pins that extend from inside the coupling edge of the first and second field end sections to inside the coupling edges of the field mid-section, wherein the field alignment system is configured to align the playing surfaces of the first and second field end sections and the field mid-section upon assembly of the robot competition field assembly so that a continuous playing field is formed without steps, and adjacent perimeter walls of the first and second field end sections and side walls of the field mid-section form a smooth continuous wall along an assembled edge of the competition field without steps.

2. The assembly of claim 1, wherein the perimeter walls of the first and second field end sections include an end wall and a pair of side walls, and the end wall and the pair of side walls are made from rectangular extruded tube, and the two side walls of the field mid-section are made from rectangular extruded tube.

3. The assembly of claim 2, wherein the brackets are L-shaped and have a vertical leg that extends along an inside side face of each the side walls of the first and second field end sections and the field mid-section so that the side walls are aligned along the assembled edge of the competition field, and a horizontal leg that extends along a bottom inside surface of the sidewalls so that the playing surfaces of each of the first and second field end sections and the field mid-section are horizontally aligned.

4. The assembly of claim 3, wherein the alignment pins include a plurality of pins spaced along a width of the coupling edges of the end panels, and the mid-panel includes a plurality of pin receiving apertures along the coupling edges that are aligned with the plurality of pins of the end panels.

5. The assembly of claim 3, wherein the brackets are fixed inside the side walls of the first and second field end sections when the first and second field end sections are decoupled from the field mid-section, and assembly bolts couple the brackets to each corner of the field mid-section when the first and second field end sections are coupled to the field mid-section.

6. A robot competition field comprising field end sections each including an end panel made from wood and having a playing surface, a pair of side edges, an end edge, and a coupling edge, an end wall that extends upward from the end edge of the end panel, and sidewalls that extend upward from the side edges of the end panels, wherein the end walls and the sidewalls that extend upward from the side edges of the end panels are made from rectangular extruded tube, a field mid-section including a mid-panel made from wood and having a playing surface, coupling edges, and side edges, and sidewalls that extend upward from the side edges of mid-panel, wherein the sidewalls that extend upward from the side edges of mid-panel are made from rectangular extruded tube, and a field alignment system configured to couple the coupling edges of the field end sections to the field mid-section upon assembly of the robot competition field, the field alignment system including brackets that extend from inside the sidewalls of the field end sections to inside the sidewalls of the field mid-section to couple the field end sections and the field mid-section together, and alignment pins that extend from inside the end panels of the field end sections to inside the mid-panel of the field mid-section at each of the corresponding the coupling edges, wherein the coupling edges are configured to be engaged and aligned so that there is a smooth transition between each of the playing surfaces upon assembly of the robot competition field, wherein the brackets are L-shaped and have a vertical leg that extends along an inside side face of each the side walls of the field end sections and the field mid-section so that the sidewalls are aligned along the assembled edge of the competition field, and a horizontal leg that extends along a bottom inside surface of the sidewalls so that the playing surfaces of each of the field end sections and the field mid-section are horizontally aligned.

7. The robot competition field of claim 6, wherein the alignment pins include a plurality of pins spaced along a width of the coupling edges of the end panels, and the mid-panel includes a plurality of pin receiving apertures along the coupling edges that are aligned with the plurality of pins of the end panels.

8. The robot competition field of claim 6, wherein the brackets are fixed inside the sidewalls of the field end sections when the field end sections are decoupled from the field mid-section, and assembly bolts couple the brackets to each corner of the field mid-section when the field end sections are coupled to the field mid-section.

9. A robot field competition system, the system comprising a first robot competition field including (1) field end sections each including an end panel made from wood and having a playing surface, a pair of side edges, an end edge, and a coupling edge, an end wall that extends upward from the end edge of the end panel, and sidewalls that extend upward from the side edges of the end panels, wherein the end walls and the sidewalls are made from rectangular extruded tube, (2) a field mid-section including a mid-panel made from wood and having a playing surface, coupling edges, and side edges, and sidewalls that extend upward from the side edges of mid-panel, wherein sidewalls are made from rectangular extruded tube, and (3) a field alignment system that couples the coupling edges of the field end sections to the field mid-section and includes brackets that extend from inside the sidewalls of the field end sections to inside the sidewalls of the field mid-section to couple the field end sections and the field mid-section together, and alignment pins that extend from inside the end panels of the field end sections to inside the mid-panel of the field mid-section at each of the corresponding the coupling edges, wherein the coupling edges are configured to be engaged and aligned so that there is a smooth transition between each of the playing surfaces upon assembly of the robot competition field, a second robot competition field including (1) field end sections each including an end panel made from wood and having a playing surface, a pair of side edges, an end edge, and a coupling edge, an end wall that extends upward from the end edge of the end panel, and sidewalls that extend upward from the side edges of the end panels, wherein the end walls and the sidewalls that extend upward from the side edges of the end panels are made from rectangular extruded tube, (2) a field mid-section including a mid-panel made from wood and having a playing surface, coupling edges, and side edges, and sidewalls that extend upward from the side edges of mid-panel, wherein the sidewalls that extend upward from the side edges of mid-panel are made from rectangular extruded tube, and (3) a field alignment system that couples the coupling edges of the field end sections to the field mid-section and includes brackets that extend from inside the sidewalls of the field end sections to inside the sidewalls of the field mid-section to couple the field end sections and the field mid-section together, and alignment pins that extend from inside the end panels of the field end sections to inside the mid-panel of the field mid-section at each of the corresponding the coupling edges, wherein the coupling edges are engaged and aligned so that there is a smooth transition between each of the playing surfaces, wherein an integrated latch is provided in a first terminal end of the end wall of the first robot competition field and an integrated catch is provided on a second terminal end of the end wall of the second robot competition field, and wherein the integrated latch is configured to be engaged with the integrated catch to fix the first robot competition field to the second robot competition field upon assembly of the robot field competition system.

10. The system of claim 9, wherein the brackets are L-shaped and have a vertical leg that extends along an inside side face of each the sidewalls of the field end sections and the field mid-section so that the sidewalls are aligned along the assembled edge of the competition field, and a horizontal leg that extends along a bottom inside surface of the sidewalls so that the playing surfaces of each of the field end sections and the field mid-section are horizontally aligned.

11. The system of claim 10, wherein the alignment pins include a plurality of pins spaced along a width of the coupling edges of the end panels, and the mid-panel includes a plurality of pin receiving apertures along the coupling edges that are aligned with the plurality of pins of the end panels.

12. The system of claim 10, wherein the brackets are fixed inside the sidewalls of the field end sections when the field end sections are decoupled from the field mid-section, and assembly bolts couple the brackets to each corner of the field mid-section when the field end sections are coupled to the field mid-section.

13. The system of claim 9, wherein the sidewalls along one side of the first robot competition field contact the sidewalls along one side of the second robot competition field while the integrated latch is engaged with the integrated catch.

14. The system of claim 13, wherein the playing surfaces of the first robot competition field are co-planar with the playing surfaces of the second robot competition field while the integrated latch is engaged with the integrated catch.

* * * * *